US005967388A

United States Patent [19]

Kolton et al.

[11] Patent Number: 5,967,388

[45] Date of Patent: Oct. 19, 1999

[54] GARMENT HANGER

[75] Inventors: Chester Kolton, Westfield; Michael Norman, East Brunswick, both of N.J.

[73] Assignee: B&G Plastics, Inc., Newark, N.J.

[21] Appl. No.: 09/088,642

[22] Filed: Jun. 2, 1998

[51] Int. Cl.[6] ..... A47G 25/48

[52] U.S. Cl. ..... 223/95; 223/85; 223/96

[58] Field of Search ..... 223/92, 95, 96, 223/85, 93, 91, 90

[56] References Cited

U.S. PATENT DOCUMENTS

| | | | |
|---|---|---|---|
| 2,205,489 | 6/1940 | Nelson | 223/95 |
| 2,608,324 | 8/1952 | Currier | 223/95 |
| 3,317,096 | 5/1967 | Bissonnette et al. | 223/95 |
| 4,703,878 | 11/1987 | Louw | 223/95 |
| 4,744,496 | 5/1988 | Blanchard | 223/95 |
| 5,065,916 | 11/1991 | Fildan | 223/96 |
| 5,129,557 | 7/1992 | Kolton et al. | 223/96 |

*Primary Examiner*—Bibhu Mohanty
*Attorney, Agent, or Firm*—Robin, Blecker & Daley

[57] ABSTRACT

An upstanding garment hanger comprises a transversely extending support member and a succession of garment support elements depending downwardly from the support member to free ends, at least first and second adjacent ones of the garment support elements defining transversely extending, vertically spaced projections upwardly of the free ends thereof.

8 Claims, 3 Drawing Sheets

GARMENT HANGER

FIELD OF THE INVENTION

This invention relates generally to hangers for garments and pertains more particularly to hangers for underwear.

BACKGROUND OF THE INVENTION

U.S. Pat. No. 4,703,878 ("the '878 patent") shows a hanger for underwear which has a transversely extending support member with a hook extending upwardly of the support member for engaging a support rail to suspend the support member. A plurality of garment interior support elements depend downwardly of the support member arcuately to the vertical and have hook formations on ends thereof to entrap an undergarment thereabove. At ends of the support member, the hanger includes downwardly and outwardly extending single garment support elements, i.e., exterior garment support elements, with projections extending outwardly of the exterior garment support elements. A notch or detent is formed in the support member above each of the exterior support elements. Such hanger exterior garment support elements are shown in U.S. Pat. No. Des. 202,240.

The hanger of the '878 patent has facility for the hanging of underwear (briefs) of various waistband sizes. Underwear is hung by applying one end of its waistband to an interior garment support element above the hooked end thereof, drawing the waistband about one of the exterior garment support elements and then applying the other end of the waistband about the other of the exterior garment support elements and then applying the other end of the waistband to another of the interior support elements. Different interior garment support elements are used for differently-sized underwear.

South Africa Patent Application No. 85/7516, which is noted in the '878 patent as the first-filed application counterpart to the application for the '878 patent, describes a similar hanger structure wherein, however, the interior garment support elements depend straightwise from the support member, i.e., the elements are not arcuate.

By way of further background to the subject invention, note is taken of a commercially-known hanger for briefs bearing the legend "PLASTI-FORM-1-800-HANGER-4". This hanger also has garment support elements which extend downwardly and straightwise from the hanger support member, i. e., not arcuately to the vertical. Contrary to the hangers of the '878 patent and the above-noted South African patent application, each of which has hook formations at the lower ends of the garment support elements, the commercially-known hanger has a spring-like member extending continuously with the ends of the garment support elements vertically upwardly toward the support member.

Common to above-discussed hangers is to provide the support member in a downwardly arcuate configuration such that the support member is not seen when the hangers support underwear.

SUMMARY OF THE INVENTION

It is the primary object of the present invention to provide improved hangers of the types above discussed.

In attaining this and other objects, the invention provides an upstanding garment hanger comprising a transversely extending support member and a succession of garment support elements depending downwardly from the support member to free ends, at least first and second adjacent ones of the garment support elements defining transversely extending, vertically spaced projections upwardly of the free ends thereof.

The projections of the first garment support element are in different vertical locations than the projections of the adjacent second garment support element and are preferably of semicircular configuration.

In use of the hanger, a waistband is inserted within a pair of the garment support elements and is engaged and retained by the projections of the garment support elements of such pair. The waistband is then drawn over one end of the support member, across the front of the support member, over the other end of the support member and is inserted rearwardly of the support member into the appropriate garment support element pair and retained by the projections of the garment support elements of such pair.

The invention will be further understood from consideration of the following description of preferred embodiments thereof and from the drawings where like reference numerals identify like parts throughout.

DETAILED DESCRIPTION OF PREFERRED EMBODIMENTS

Figure 2:
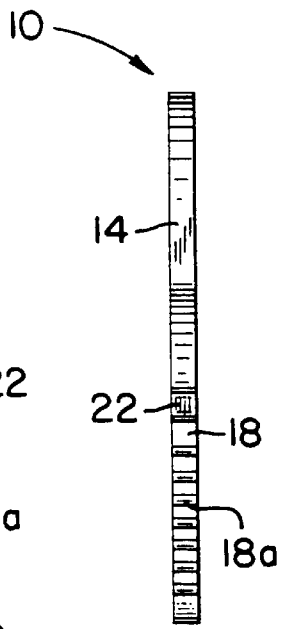
FIG. 2 is a right side elevation of the FIG. 1 hanger.
Figure 1:
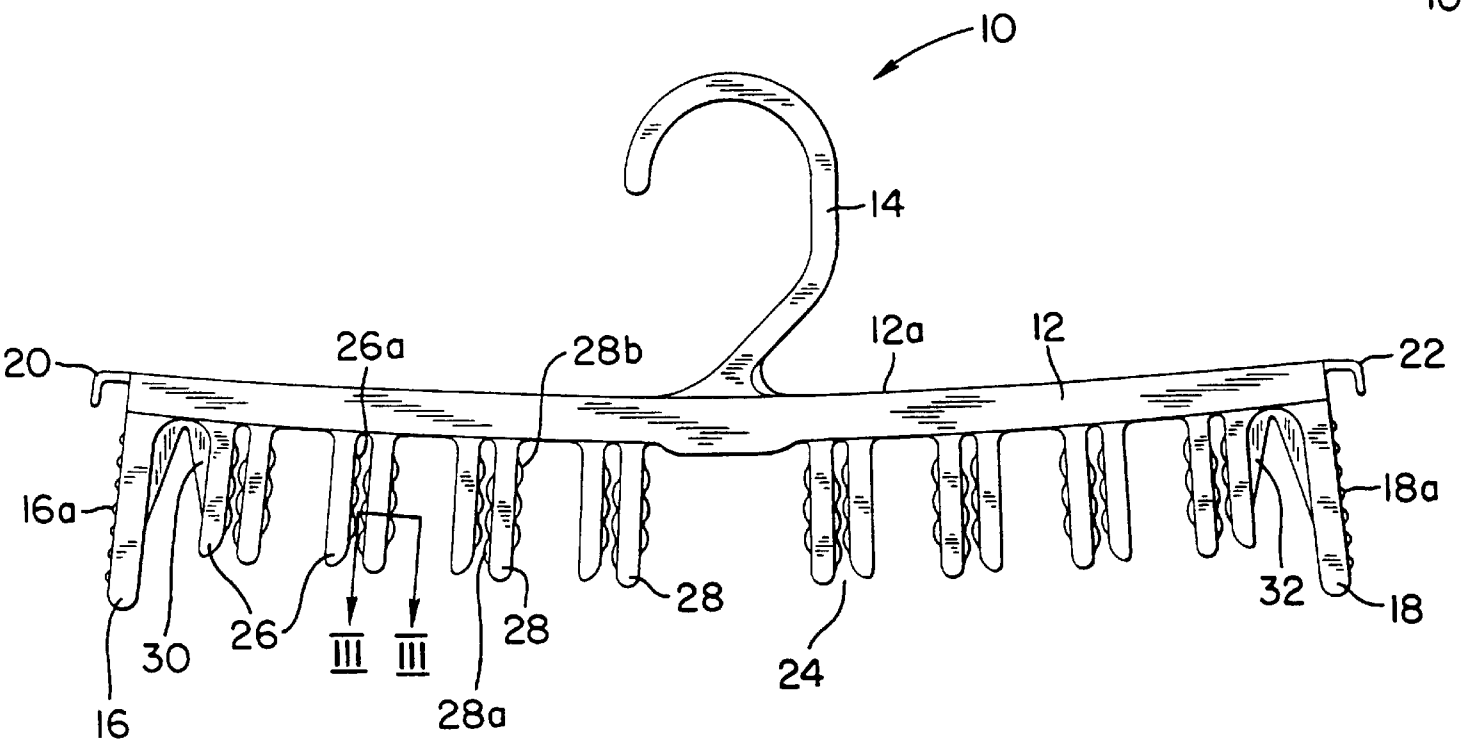
FIG. 1 is a front elevation of a hanger in accordance with the invention.

Referring to FIG. 1, upstanding garment hanger 10 is formed of plastic as a one-piece body, as by plastic molding. Hanger 10 includes a transverse garment support member 12 and a hook 14 for receiving a display rod.

At ends of support member 12 are garment guide members 16 and 18 which have respective outer surfaces with garment engaging dimples 16*a* and 18*a*. Detents 20 and 22 extend outwardly over guide members 16 and 18.

Interiorly of guide members 16 and 18, garment support elements depend in pairs downwardly of support member 12. Each pair of garment support elements includes a garment support element 26 and a garment support element 28.

Figures 3, 4:
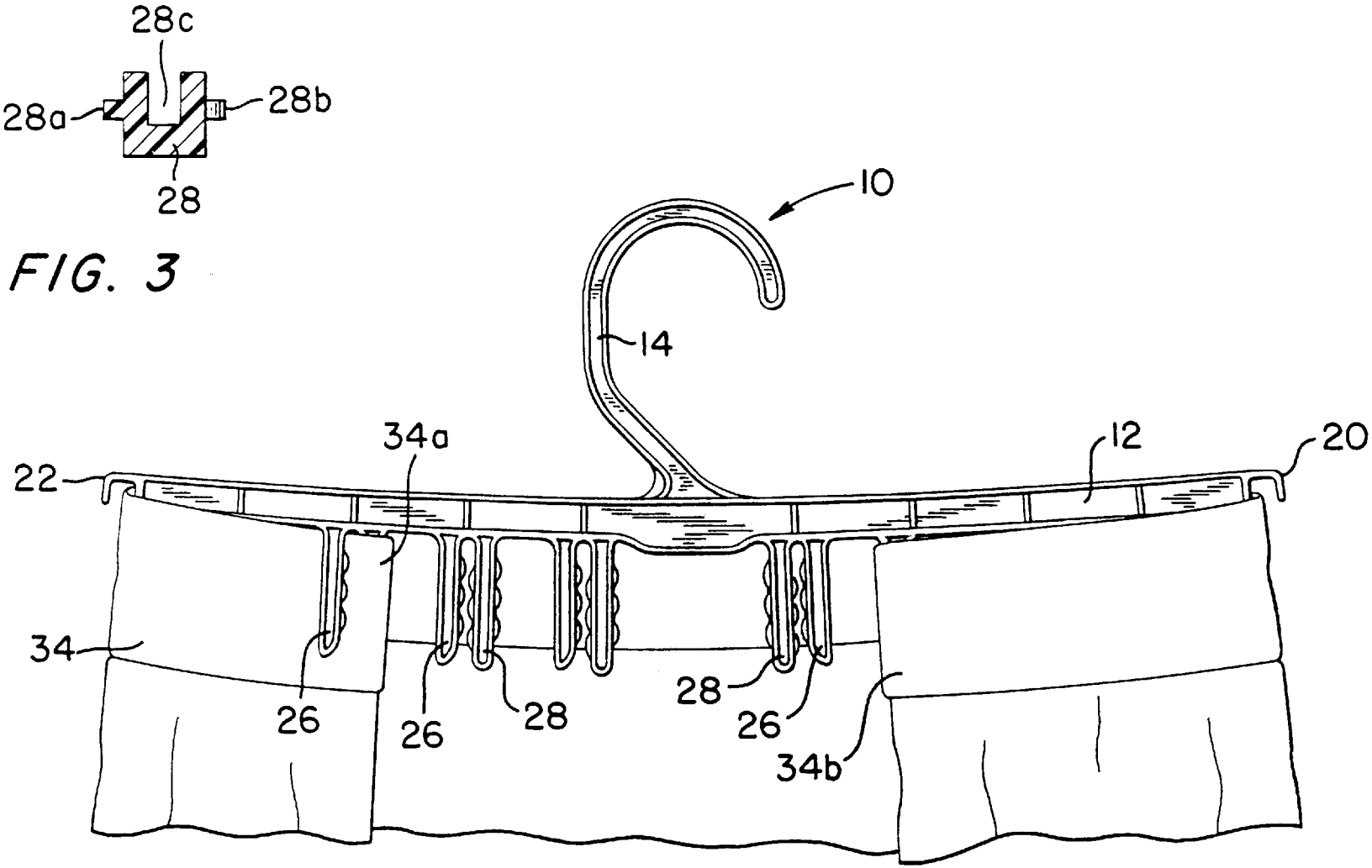
FIG. 3 is an enlarged sectional view as would be seen from plane III—III of FIG. 1.
FIG. 4 is a rearward showing of FIG. 1 with a garment shown assembled therewith in one manner.

Each of garment support elements 26 has projections 26*a* extending transversely outwardly thereof toward one of garment support elements 28. Each of garment support elements 28 has projections 28*a* extending transversely outwardly thereof toward one of garment support elements 26 and projections 28*b* extending oppositely transversely outwardly thereof. As is seen in FIG. 3, projections 26*a*, 28*a* and 28*b* are of lesser extent depthwise of hanger 10 than are support elements 26 and 28. Webs 30 and 32 are likewise of lesser extent depthwise of hanger 10 than are support elements 26 and 28.

Projections 26*a* of support element 26 are in different vertical locations than projections 28*a* of garment support element 28, and vice versa. In the preferred, illustrated embodiment, each of the projections of the second support element is vertically successive to a projection of the first garment support element. Further, projections 28*a* and 28*b* are in same vertical locations. All of projections 26*a*, 28*a* and 28*b* are preferably semicircular in configuration. Referring to FIG. 3, support element 28 will be seen to have a vertical channel 28*c* as is the case also for support element 26.

Referring to FIG. 4, in reaching this assembly of hanger 10 and underwear 34, waistband end 34*a* is inserted within a pair of the garment support elements and is engaged and retained by the projections of the garment support elements of such pair. The waistband is then drawn over guide member 18 interiorly of detent 22, across the front of support member 12, over guide member 16 interiorly of detent 20 and then waistband end 34*b* is inserted into another selected pair of garment support elements, being first drawn over projections 28*b* thereof and retained by the projections of such pair of garment support elements. Since support member 12 is configured to be downwardly arcuate in its surface 12*a*, it is not seen in viewing the front of the hanger with underwear assembled therewith.

Figure 5:
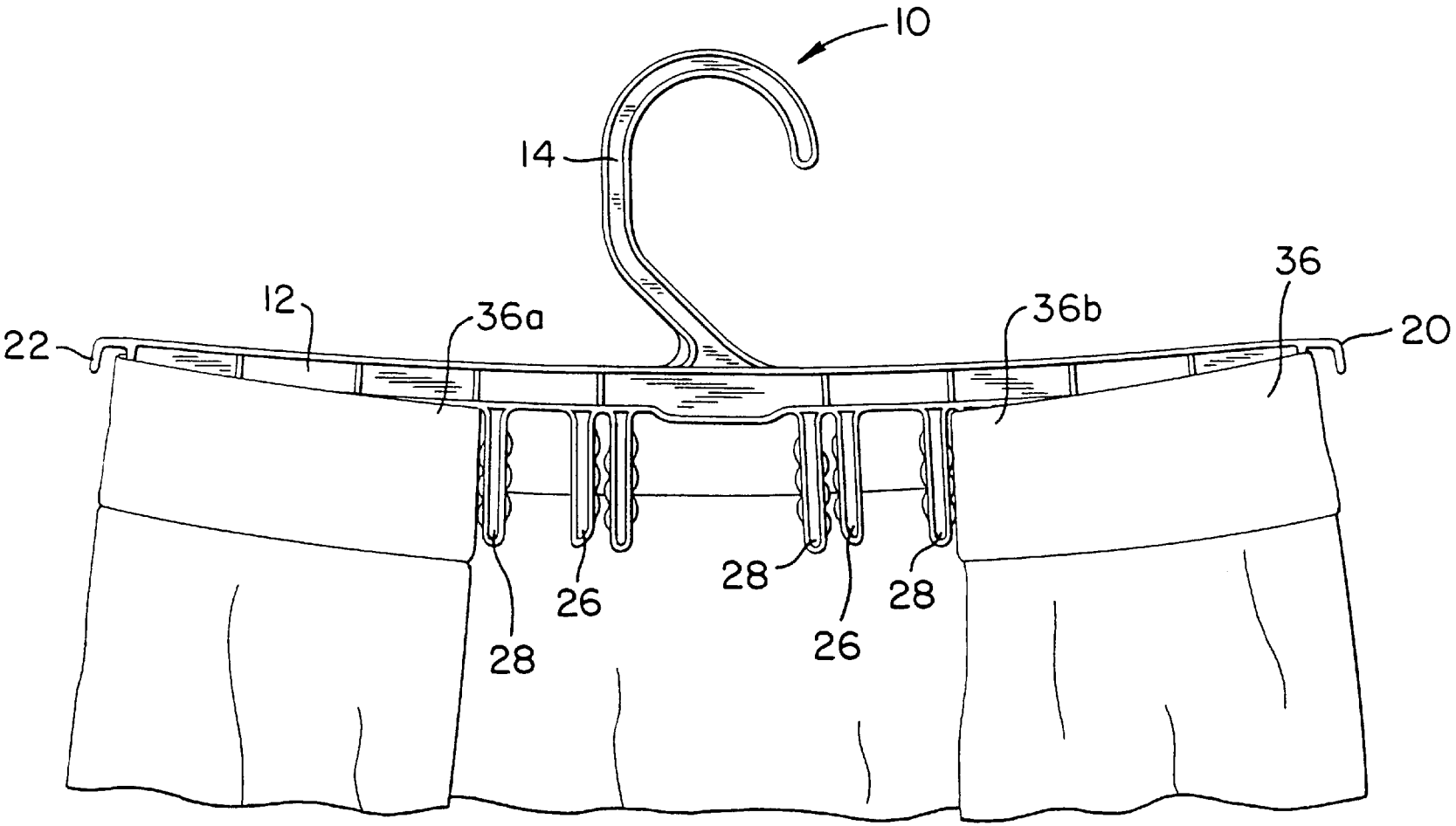
FIG. 5 is a rearward showing of FIG. 1 with a garment shown assembled therewith in another manner.

FIG. 5 illustrates a second manner of assembling a waistband 36 with the hanger. Waistband end 36*a* is inserted within a pair of the garment support elements such that a support element 26 is interior of the waistband end and is engaged and retained by the projections of the garment support elements of such pair. The waistband is then drawn over guide member 18 interiorly of detent 22, across the front of support member 12, over guide member 16 interiorly of detent 20 and then waistband end 36*b* is inserted into another selected pair of garment support elements, a support element 26 being interior of the waistband and retained by the projections of such pair of garment support elements.

From the foregoing, the invention will be seen to provide an upstanding garment hanger comprising a transversely extending support member and a succession of garment support elements depending downwardly from the support member to free ends, at least first and second adjacent ones of the garment support elements defining transversely extending, vertically spaced projections upwardly of the free ends thereof.

From another perspective, the invention will be seen to provide an upstanding garment hanger, comprising a transversely extending support member and a succession of transversely spaced pairs of garment support elements depending downwardly from the support member to free ends, the garment support elements of each of the spaced pairs defining transversely extending, vertically spaced projections upwardly of the free ends thereof.

Also, the invention will be seen to provide an upstanding garment hanger, comprising a transversely extending support member and a succession of transversely spaced pairs of garment support elements depending downwardly from the support member to free ends, one garment support element of each of the spaced pairs of having projections extending transversely outwardly of both vertical sides thereof and the other garment support element of each of the spaced pairs having projections extending transversely outwardly of one vertical side toward the one garment support element. A second vertical side of the other garment support element of each of the spaced pairs is a planar, projection-free surface.

Various changes to the particularly depicted embodiment of the invention may be introduced without departing from the scope of the invention. By way of example, the hook portion of the hanger may include a so-called "side sizer system" whereby a size marker may mounted on the hanger in a self-locking manner as is shown in U.S. Pat. No. 5,687,887, to which incorporating reference is made. Accordingly, it is to be appreciated that the particularly disclosed embodiments are intended in an illustrative, and not in a limiting, sense. The true spirit and scope of the invention is set forth in the ensuing claims.

What is claimed is:

1. An upstanding garment hanger, comprising:

a transversely extending support member;

a hook extending vertically upwardly of said support member;

first and second garment guide members extending vertically downwardly from said support member at respective opposite transverse ends of said support member;

a succession of mutually transversely spaced pairs of garment support elements on each side of said hook and depending vertically downwardly directly from said support member to free ends, said pairs of garment support elements being disposed transversely interiorly of said first and second garment guide members;

first and second adjacent ones of said garment support elements of each garment support element pair defining transversely extending, vertically spaced projections upwardly of said free ends thereof in mutually facing relation for jointly retentively engaging a garment therebetween.

2. The garment hanger claimed in claim 1, wherein said projections of said first garment support element are in different vertical locations than said projections of said second garment support element.

3. The garment hanger claimed in claim 2, wherein each of said projections of said second garment support element is vertically successive to a projection of said first garment support element.

4. The garment hanger claimed in claim 1, wherein said projections are semicircular in configuration.

5. The garment hanger claimed in claim 4, wherein said projections of semicircular configuration of said first garment support element are in different vertical locations than said projections of said second garment support element.

6. The garment hanger claimed in claim 4, wherein each of said projections of semicircular configuration of said second garment support element is vertically successive to a projection of semicircular configuration of said first garment support element.

7. The garment hanger claimed in claim 1, wherein said projections have lesser extents depthwise of said hanger than said garment support elements.

8. The garment hanger claimed in claim 1, further including garment guide members located at opposite transverse ends of said support member.

* * * * *